United States Patent [19]

Grindle

[11] 4,425,609

[45] Jan. 10, 1984

[54] FIXTURE FOR HAZARDOUS AREA

[75] Inventor: James L. Grindle, Hendersonville, N.C.

[73] Assignee: General Electric Company, Schenectady, N.Y.

[21] Appl. No.: 426,486

[22] Filed: Sep. 29, 1982

[51] Int. Cl.[3] ..... F29V 29/00

[52] U.S. Cl. ..... 362/373; 362/362; 362/267; 362/376; 285/94; 285/355; 285/390

[58] Field of Search ..... 285/94, 355, 390; 362/362, 373, 267, 376

[56] References Cited

U.S. PATENT DOCUMENTS

| | | | |
|---|---|---|---|
| 2,786,936 | 3/1957 | Appleton | 362/376 |
| 3,101,207 | 8/1963 | Pavel et al. | 285/355 |

*Primary Examiner*—Stephen J. Lechert, Jr.

*Attorney, Agent, or Firm*—Ernest W. Legree; Philip L. Schlamp; Fred Jacob

[57] ABSTRACT

Thread joints in explosion-proof electrical fixtures for hazardous areas must relieve the momentary pressure from an internal explosion without flame propagation to the exterior. Ordinary paint on the threads cannot be used due to variations in thickness which alter the flow characteristics and the cooling effects. The invention provides a dense, pinhole-free paint layer uniform in thickness within ±15% which can be achieved by electrodeposition. Such a coating facilitates assembly and inhibits deterioration of the clearance path through corrosion but has only a minor effect on the venting relief.

10 Claims, 3 Drawing Figures

FIXTURE FOR HAZARDOUS AREA

The invention relates to thread joints in electrical fixtures intended for use in areas classified as hazardous because of the presence of combustible gas, vapor or dust, and is more particularly concerned with thread joints in lighting fixtures or luminaries.

BACKGROUND OF THE INVENTION

Lighting fixtures listed by Underwriters' laboratories (UL) as suitable for use in hazardous locations (Class I, Division 1) are required to have enclosures for the electrical components having sufficient strength to withstand the explosion pressure should there be an electrical or other malfunction that ignites the gases inside. Furthermore, as the momentary pressure from the explosion inside relieves itself to the outside, the ignited gas must be cooled sufficiently as they exit that explosive gases on the outside are not ignited. This latter quality is commonly referred to as non flame-propagation through the joints.

External propagation of flame through joints of the enclosure, such as metal-to-metal or metal-to-glass joints, is prevented by limiting the clearance between parts inversely with the length of the path through the joint. Two types of joint are commonly used. One type consists of flat mating or matching rabbeted surfaces and they must meet specified path length and clearance requirements. The other type to which this invention particularly addresses itself utilizes screw threads having a required clearance between mating threads and a specified minimum number of full threads in engagement.

With respect to thread joints, in order to assure consistent clearance between the threads, it has been necessary up to the present time to avoid painting the thread surfaces. Avoidance of paint on thread joints has in fact been mandated by UL on the grounds that if paint were allowed, variations in coverage thickness, type of paint, bubbles etc. could alter the flow characteristics and cooling effects on the explosive exhaust gases. These same variations could also cause difficulty in screwing the mating parts together. Lack of paint on threads favors corrosion, binding in threaded joints, and galling of the thread surfaces particularly where both parts are made of aluminum. In lighting fixtures used in areas with serious corrosion problems, threads not protected by paint or other corrosion inhibitor are vulnerable to rapid deterioration causing enlargement of the clearance path and increasing the probability of the occurrence of flame propagation within the lifetime of the product.

Corrosion and binding in threads may be reduced to some extent by coating the threads with an approved lubricant such as mineral oil base greases, petroleum jelly, or silicone base greases. Approval for the use of lubricant on the screw threads is covered in UL Bulletin of Research Number 4 titled "Effect of Grease in Metal Joints on Safe Operation of Explosion-Proof Electrical Equipment" (Fifth Printing—April 1977). However, according to the bulletin, regardless of the amount of grease applied, only a thin film remains on each joint surface after an explosion test, and deposits of grease in proportion to the amount applied are found on screens placed a few inches away from the joints. Thus while greases of suitable composition do not reduce the margin of safety with respect to non flame-propagation through joints, the greases are blown out whenever an explosion occurs and the protection against corrosion is at best limited and only temporary.

SUMMARY OF THE INVENTION

The object of the invention is to improve the corrosion resistance of threaded joints in explosion proof electrical fixtures intended for hazardous locations, without causing explosive pressure build-up in the fixture and without deleteriously affecting non flame-propagation through the joint.

In accordance with my invention, I have found that through electrophoretic application of paint on the threaded surfaces, a dense, pinhole-free coating of uniform thickness can be consistently achieved and the coating has a surprisingly beneficial and synergistic effect on corrosion control, ease of assembly of threaded parts and maintenance or product life. Such coating assures uniform clearance between the threads whereby constant flow characteristics and cooling effects on the explosive gases are achieved together with the desired corrosion control. Preferably the paint coating is electrophoretically applied on free-running low friction threads such as Acme, square or similar threads used for the fixture parts, and is cured by baking 15 to 30 minutes at temperatures from 300° to 400° F.

An electrical fixture embodying the invention is provided with a paint coating on the metal screw threads of the interlocked wall-defining portions of the fixture. The paint coating has the hardness, denseness, freedom from flaws such as runs, drips, pinholes, or bubbles and consistency of coverage characteristic of electrophoretic deposition. The coating is smooth and uniform in thickness within ±15% and its overall or mean thickness is small enough that it has at most a minor effect on the venting relief geometry of the thread joint. Mean coating thickness in the range from 0.0006" to 0.002" may be used, depending in part on choice of thread and thread clearance.

DESIGNATION OF FIGURES

DETAILED DESCRIPTION

Electrophoretic painting is an electrodeposition process in which paint particles are suspended in an electrolyte (water) and caused to migrate and deposit on a conductive surface by means of an applied electrical potential. The process is well-known and is described for instance in U.S. Pat. Nos. 3,230,162—Gilchrist, Electropainting Process and Paint Binder, and 3,369,983—Hart et al., Electrodeposition Process. In anodic coatings common with present day formulations, the paint particles are negatively charged. The work piece or article to be painted is made the anode by connection to the positive terminal of a d.c. power supply, and the metal walls of the tank, or alternatively separate electrodes insulated from the walls, are made the cathode. One way of controlling the thickness of the paint film deposited on the anode is through regulation of the output voltage from the power supply. As the film builds up in thickness, it becomes densified or low in volatile components through electro-osmosis. The net result is the deposition of a film which is high in solids and therefore relatively dry and abrasion resistant. Because most of the volatile components have been removed, an electrodeposited film can be baked shortly after application without fear of solvent popping, runs, sags or solvent washing in recessed areas.

An important characteristic of the electrodeposition process referred to as "throwing power" is the ability to uniformly coat irregular shapes and recessed areas. When voltage is first applied to an anode of irregular configuration, deposition will begin at the terminus of the path of least resistance, namely on leading edges and surfaces of the work piece closest to the cathodes in the tank. Due to the insoluble nature of the deposited films, their electrical resistance increases and they become insulative in character. The paths of lowest electrical resistance are now between the cathodes and the areas on the work piece which are not coated with deposited film even though they are further removed. Thus electrodeposition is a dynamic process, obeying within limits Ohm's law and Faraday's laws, and being dependent on such factors as time, temperature, voltage, cathode placement, and anode-cathode area relationships.

As the processed work piece emerges from the tank, a thin dipcoat of bath material adheres to the deposited film. This dipcoat or drag-out may be removed by spray rinsing the work piece with water immediately after deposition. The part is then ready for baking, and typically the cure may require from 15 to 30 minutes at temperatures of 300° to 400° F.

Figure 1:
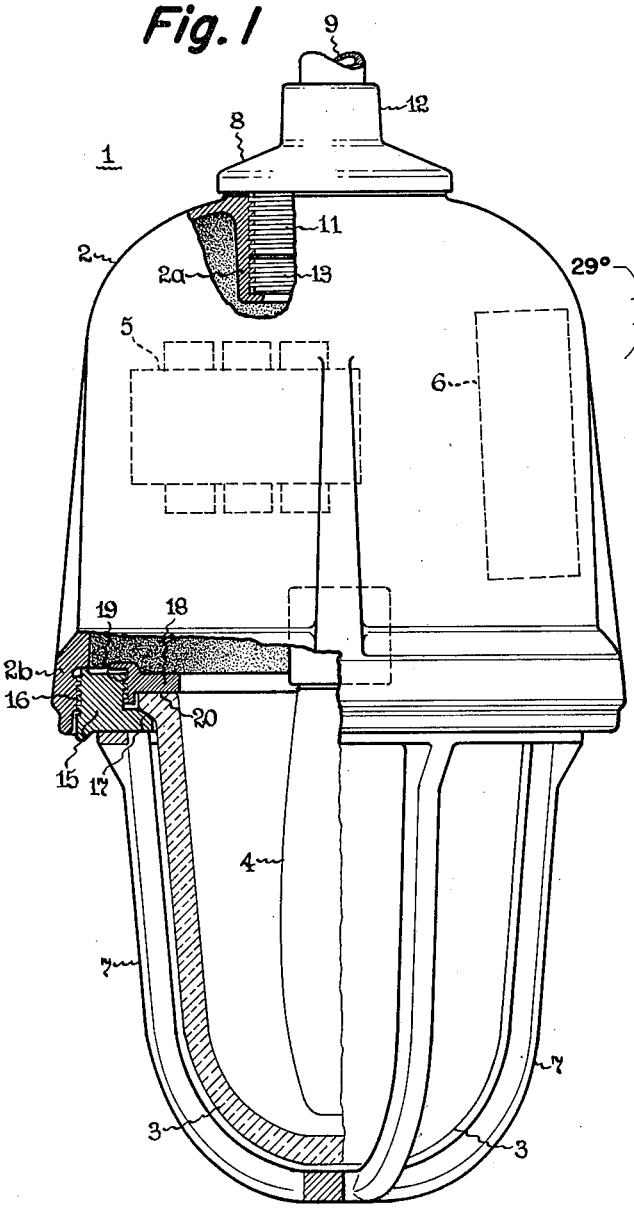
FIG. 1 is an elevation view of an industrial type luminaire for hazardous locations having portions cross-sectioned to show threaded parts.

Referring now to the drawing and particularly to FIG. 1, there is shown a lighting fixture or luminaire 1 of hazardous duty type comprising an upper ballast housing 2 and a globe 3 of light-transmitting material such as glass or similar material enclosing a lamp 4 which is typically of gaseous discharge type such as a high pressure mercury vapor or sodium vapor type, the latter being illustrated. The lamp is connected to and operated by electrical ballast components comprising a core and coil assembly 5 and a capacitor 6, both shown in dotted outline only, contained in housing 2. An optional cage-like protective guard 7 secured along the bottom edge of ballast housing 2 and extending around glass globe 3 may be provided. The luminaire 1 is supported by a hub 8 fastened to the end of a conduit 9, suitably ¾" or 1" steel pipe. The hub proper has standard V-thread in a pipe thread configuration in upper collar portion 12 for screwing onto the similarly threaded end of conduit 9.

Lighting fixture 1 is mounted onto hub 8 by engaging the female Acme threads in the upper socket portion **2*a* of housing 2 with the male Acme threads 11 on the lower portion of hub 8**. These cooperating threads provide both the mechanical support for the lighting fixture and the necessary venting while preventing flame propagation.

Positioned at the bottom of the socket portion **2*a* is a disc 13 of plastic insulating material which contains sealed electrical conducting means for connection between the incoming line leads and the internal components. Disc 13 is also provided with male Acme threads which engage the female Acme threads in socket portion 2*a***, and seals off the luminaire from the conduit as required by National Electrical Code (Article 501-5) which states that a seal must be provided between the incoming conduit and any chamber containing any components which may produce arcs, sparks, or high temperatures.

Glass globe 3 closing the lower end of the housing is supported by globe ring 15 which is provided with male Acme threads 16 engaging cooperating female threads on the inside of the lower edge or skirt **2*b* of the housing. The support of the glass globe occurs through the engagement of its outer rim by the inner curving shoulder 17 of the globe ring. At the same time an inner clamp ring 18 having male Acme threads 19 engages cooperating female threads in globe ring 15 and presses and locks the rim of the globe down against curving shoulder 17 of the globe ring. The upper surface of the rim of the globe is ground flat at 20** and is engaged by the flat underside of the clamp ring to make a seal.

Figure 2:
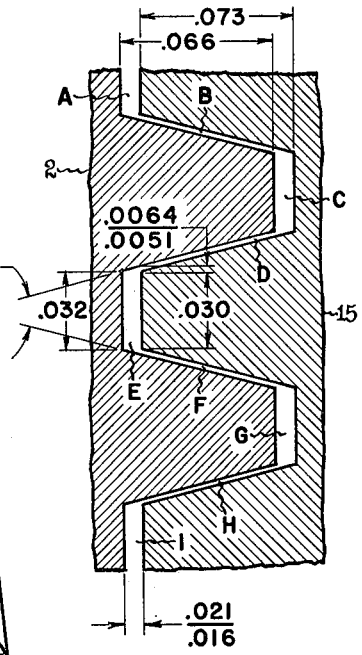
FIG. 2 is an enlarged section of Acme threads showing typical dimensions and tolerances.

In the above-described threaded joints serving to interlock wall-defining positions of the fixture, Acme threads are formed by a precision ground tool having essentially a blunted wedge shape of 29° included angle. Some details of this thread with respect to dimensions and tolerances (in inches) of the male and female parts for a typical 10 pitch 2G size are shown in FIG. 2. The thread form and fit is maintained while the diameter of the part is varied to suit the location of the screw threads. The threads are cut by numerically controlled equipment and the gauging requirements insure an interchangeable fit. By comparison with American Standard thread utilizing a V shape with a 60° included angle, Acme threads have greater exposed surface length and the straighter sides offer more consistent gap control, freer movement, lower friction and less galling.

Figure 3:
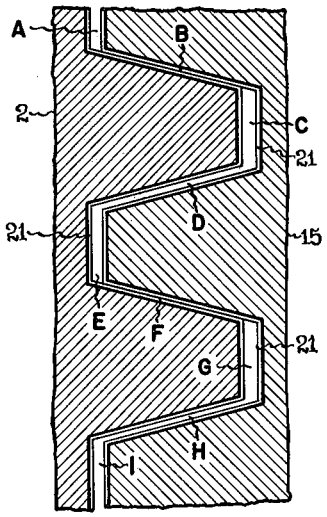
FIG. 3 is an enlarged section of interlocked Acme threads, each threaded part having an electrophoretically applied paint coating of uniform thickness in accordance with the invention.

The shortest possible flame path through a threaded joint such as in FIG. 2 is the zig-zag path deflected alternately right and left by the threads at any place on the diameter. This path whose length is the sum of the thread profiles from end gap A through side gap B to end gap C, through side gap D to end gap E etc. may be termed the direct venting path. However in a real situation, the threaded joint is usually biased by the load so that the axial thread backlash is all taken to one side. Thus in FIG. 2 for a vertical mounting of the fixture, the female threads on the inside of the skirt of housing 2 support the male threads of the globe ring 15 which in turn supports the weight of glass globe 3. The bias in the axial backlash would tend to close side gaps B and F and open side gaps D and H. As indicated in FIG. 2, the side clearance between threads is from 0.0051" to 0.0064". Thus side gaps B and F may be reduced to 0.0000 while side gaps D and H may open to 0.0102" as a minimum and to 0.0128" as a maximum. In such case the direct path from end gap A to end gap C through side gap B is blocked, as suggested in FIG. 3. However the hot gases can nevertheless exit by the spiral path produced by following end gap A a full turn around until it becomes end gap E, then end gap I etc.

In practice, notwithstanding the bias or load on the thread joint, imperfections in the thread surfaces and in the machining of the threads prevent a complete closure of side gaps B and F. The actual venting path becomes the resultant of some gas flow through the direct path from thread to thread, and some gas flow through the spiral path circling the threaded joint. My invention is based upon the realization that the type of paint coating achieved by electrodeposition may be applied to the threads in thread joints, such as illustrated in FIG. 2 without deleteriously affecting the venting and the non flame-propagation characteristics.

Electrodeposition permits application of a uniform film, typically 0.0012" thick. With such a film, the side clearance between threads, nominally 0.0051" to 0.0064" is reduced by the thickness of two paint films, namely to 0.0027" to 0.0040". It is apparent that the direct venting path remains open. As for the spiral path, the paint film will reduce the end gap clearance of 0.016" to 0.021" to a clearance of 0.0136" to 0.0186". Clearly the spiral path venting which depends on end gap clearance will be affected even less than the direct path venting. Of course if it is desired to maintain exactly the direct path and the spiral path venting which the thread joint had become electrodeposition of paint, this may readily be achieved by modifying the thread dimensions to compensate for the thickness of the paint film without appreciably affecting the mechanical characteristics of the threads.

Therefore in accordance with the invention, a thin, hard and essentially pinhole-free paint coating is provided on the threads of fixtures intended for use in hazardous areas. By utilizing electrophoretic deposition, an excess of paint which would limit venting and possibly cause an increase in the measured explosion pressure is avoided. A coating whose thickness is uniform within ±15% and free of flaws such as pinholes or lack of coating on sharp edges and other inaccessible places is applied to the threads as shown at 21 in FIG. 3. Its effect on the geometry venting relief is minimal, and, by reason of the thickness uniformity, is readily compensated. Mean coating thickness is generally in the range of 0.0006" to 0.002", preferably 0.0008" to 0.0016" for low friction threads. For the Acme threads described, I have used an acrylic base thermo-setting baking type electro-coat enamel of light gray color available for DeSoto Inc., 1700 South Mount Prospect Rd., DesPlaines, Ill. 60018. The resulting paint film had a mean thickness of 0.0012 with a thickness variability less than ±10%.

I have found that the application of paint to the threads as described inhibits deterioration of the clearance path and greatly extends the safe useful life of the fixture. In addition friction between the mating parts is reduced for the life of the fixture and the need for greases or other lubricants is considerably reduced or eliminated. The invention thus provides a solution to the long standing problem of the conflicting demand of controlling corrosion and assuring ease of assembly and disassembly, while avoiding pressure build-up and preventing flame propagation in hazardous area luminaires.

While the invention has been described with reference to a particular embodiment used in an industrial type luminaire for hazardous locations, it will be understood that it is equally applicable to other thread joints for electrical fixtures and that numerous modifications may be made by those skilled in the art without departing from the scope of the invention. The appended claims are intended to cover all such equivalent variations as come within the true spirit and scope of the invention.

What I claim as new and desire to secure by Letters Patent of the United States is:

1. A hazardous area electrical fixture required to withstand the pressure of an internal explosion and to provide venting to the outside without flame propagation comprising:

at least two metal parts forming wall-defining portions of said fixture, said parts being provided with screw threads interengaged to make a thread joint between said portions, said threads having clearance between them and defining a geometry assuring venting relief without flame propagation, and a thin, hard, essentially pinhole-free paint coating on said threads, said coating being uniform in thickness with a variability not exceeding ±15% of the mean thickness and having an overall thickness small enough to have at most only a minor effect on the venting relief geometry of the thread joint.

2. A fixture as in claim 1 wherein said screw threads are a low friction type.

3. A fixture as in claim 1 wherein said paint coating has a mean thickness in the range of 0.0006" to 0.002".

4. A fixture as in claim 1 wherein the screw threads are a low friction type and said paint coating has a mean thickness in the range of 0.0008" to 0.0016".

5. A fixture as in claim 4 wherein said paint coating is approximately 0.0012" thick with a variability not exceeding ±10%.

6. A hazardous area electical fixture required to withstand the pressure of an internal explosion and to provide venting to the outside without flame propagation comprising:

at least two metal parts forming wall-defining portions of said fixture, said parts being provided with screw threads interengaged to make a thread joint between said portions, said threads having clearance between them and defining a geometry assuring venting relief without flame propagation, and a paint coating on said threads, said coating having the hardness, denseness, freedom from flaws and consistency coverage characteristic of electrophoretic deposition, said coating being uniform in thickness with a variability not exceeding ±15% of the mean thickness and having an overall thickness small enough to have at most a minor effect on the venting relief geometry of the thread joint.

7. A fixture as in claim 6 wherein said screw threads are a low friction type.

8. A fixture as in claim 6 wherein said paint coating has a thickness in the range of 0.0006" to 0.002".

9. A fixture as in claim 6 wherein the screw threads are a low friction type and said paint coating has a mean thickness in the range of 0.0008" to 0.0016".

10. A fixture as in claim 9 wherein said paint coating is approximately 0.0012" thick with a variability not exceeding ±10%.

* * * * *